US007777113B1

(12) United States Patent
Chang

(10) Patent No.: US 7,777,113 B1
(45) Date of Patent: Aug. 17, 2010

(54) SUPPORT FOR A PRACTICING DRUM OR ELECTRONIC DRUM

(75) Inventor: Ming-Yi Chang, Taichung (TW)

(73) Assignee: Remarkable Company, Taichung (TW)

( * ) Notice: Subject to any disclaimer, the term of this patent is extended or adjusted under 35 U.S.C. 154(b) by 0 days.

(21) Appl. No.: 12/501,447

(22) Filed: Jul. 12, 2009

(51) Int. Cl.
*G10D 13/02* (2006.01)

(52) U.S. Cl. ..... 84/411 R

(58) Field of Classification Search ..... 84/411 R, 84/420, 411 P

See application file for complete search history.

(56) References Cited

U.S. PATENT DOCUMENTS 7,638,701 B2 * 12/2009 May, Jr. ..... 84/411 P

* cited by examiner

*Primary Examiner*—Kimberly R Lockett
(74) *Attorney, Agent, or Firm*—Wang Law Firm; Li K. Wang

(57) ABSTRACT

A support for a practicing drum or electronic drum includes a pipe element with several stands. The pipe element is penetrated with a vertical bar. The support has a bar element whose both ends have first and second adjusting structures, respectively. The vertical bar goes through the first adjusting structure. The second adjusting structure has a side bar whose end is disposed with an instrument, such as drum or cymbal. The first and second adjusting structures enable the bar element and the side bar to change their orientations and positions. An instrument pedal is disposed underneath the pipe element. The instrument pedal and the pipe element are connected by a connecting structure to achieve firm positioning.

9 Claims, 10 Drawing Sheets

SUPPORT FOR A PRACTICING DRUM OR ELECTRONIC DRUM

BACKGROUND OF THE INVENTION

1. Field of Invention

The invention relates to a support for a practicing drum or electronic drum and, in particular, to a support that can adjust the orientation of the drum and the length of itself.

2. Related Art

FIG. 10 shows a placement support 5 of a conventional drum. The placement support has a stand 51 in the lower part. The placement support 5 includes a vertical bar 52 with a tightening element 53. One side of the tightening element 53 allows a side bar 54 to go through. The end of the side bar 54 is bent for the placement of an instrument, such as a practicing drum 55.

However, adjusting the side bar 54 can only adjust the inner or outer position of the drum 55. Or the tightening element 53 can only adjust the vertical position thereof. Obviously, the position and orientation of the drum 55 are limited. This is quite inconvenient.

As shown in FIG. 11, there is usually a big drum (not shown) in a band. The big drum is to be hit by a drumstick (not shown). In normal practices, the instrument pedal 61 with a drumstick is usually connected to the placement support for fixing it. A U-shaped position limiting element 62 is horizontally inserted into the bottom of the vertical bar 52. A positioning bar 63 goes through the positioning limiting element 62 and into the bottom of the vertical bar 52. A screw 621 horizontally provided on the position limiting element 62 further urges against the sidewall of the vertical bar 52 for fixing. Besides, the bottom of the positioning bar 63 is disposed on a board 64. One side of the board 64 is held positioned by a holding element 611 of the instrument pedal 61.

The screw 621 exerts a sideway shear force to push the vertical bar 52 horizontally, so that the vertical bar 52 and the positioning bar 63 underneath it are engaged inside the positioning limiting element 62. However, the positioning bar 63 is not directly urged and positioned. There is still the problem of wiggling and even falling when one practices beating the drum.

SUMMARY OF THE INVENTION

In view of the foregoing, an objective of the invention is to provide a support for a practicing drum of electronic drum with first and second adjusting structures that can change the orientation and length. The bar and side bar in the invention offer more choices of orientations and positions for the user.

Another objective of the invention is to provide a connecting structure so that the instrument pedal and pipe element have a more stable connection and better positioning.

To achieve the above-mentioned objectives, the invention includes:

a hollow pipe element having a plurality of stands around it and a fixing structure on the outer side;

a vertical bar going through the pipe element, with the fixing structure urging and positioning the vertical bar;

at least one bar element provided on the vertical bar, which has a hollow part on at least one end and first and second adjusting structures on its both ends; wherein the vertical bar vertically goes through the first adjusting structure, the second adjusting structure is provided on the end with the hollow part, and the bar element has multiple orientations and positions;

an instrument pedal disposed next to the stands of the pipe element, which has a drumstick;

wherein the pipe element has a foam pad for the drumstick to hit, a connecting structure is disposed between the instrument pedal and the pipe element and has a bottom board, one side of the bottom board is held and positioned by a holding element disposed on the instrument pedal, the bottom end of the pipe element is mounted with a ring element, the other side of the bottom board has a positioning bar, the positioning bar goes from the bottom end of the ring element into the pipe element, and a locking element goes through the sidewall of the ring element and urges against the sidewall of the positioning bar, thereby achieving a stable positioning effect.

BRIEF DESCRIPTION OF THE DRAWINGS

The invention will become more fully understood from the detailed description given herein below illustration only, and thus is not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Please refer to FIGS. 1 to 9 for an embodiment structure of the invention. They are used only for the purpose of illustration and should not be used to restrict the scope of the invention.

Figure 1:
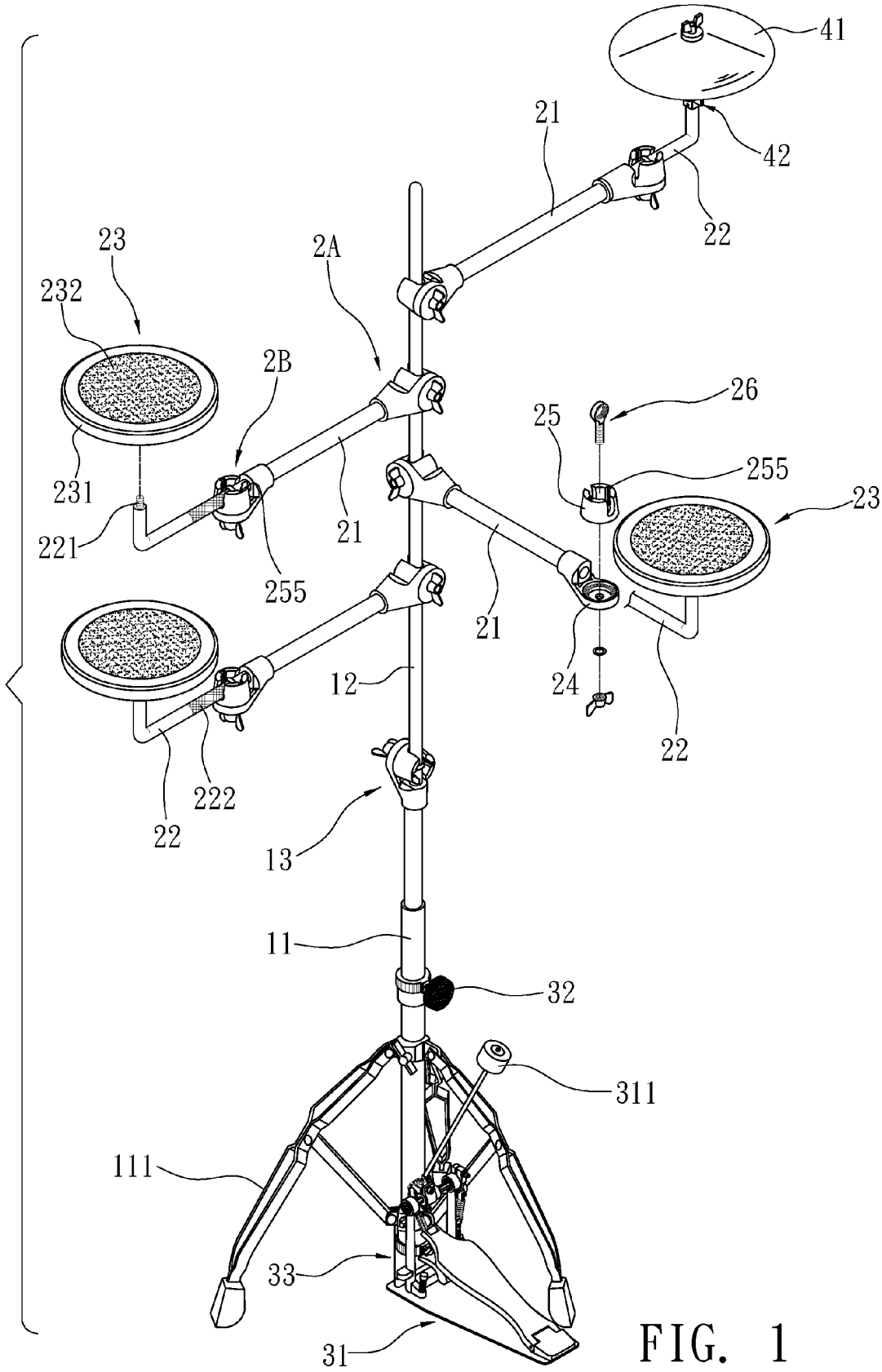
FIG. 1 is a three-dimensional view of the invention.
Figure 2:
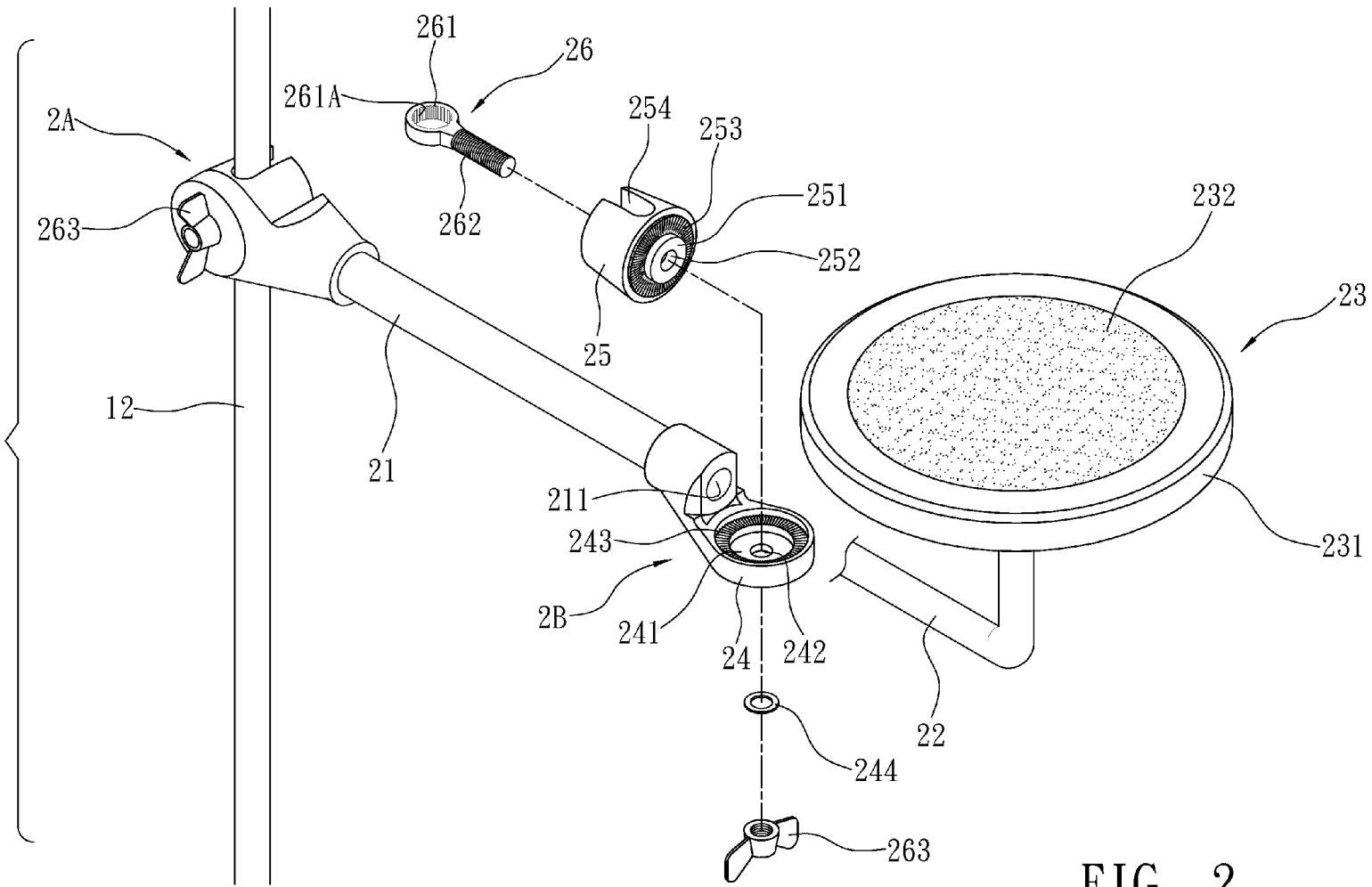
FIG. 2 is an exploded view of the components at the bar element of the invention.

Please refer to FIGS. 1 and 2. The following description assumes that the invention is used as the support of a practicing drum or electronic drum.

The invention includes a hollow and vertical pipe element 11, a vertical bar 12, at least one bar element 21, and a side bar 22.

Several stands 111 are provided around the pipe element 11. For example, three stands are disposed at equal angular interval. The vertical bar 12 is vertically disposed in the pipe element 11. The outer side of the pipe element 11 has a fixing structure 13. The fixing structure 13 urges and positions the vertical bar 12. Besides, the vertical bar 12 has many anti-skid structures (not shown).

Each of the bar elements 21 is disposed on the vertical bar 12 vertically or at an angle. AT least one end of the bar element 21 has a hollow part 211. Both ends of the bar element 21 are provided respectively with a first adjusting structure 2A and a second adjusting structure 2B. The vertical bar 12 vertically goes through the first adjusting structure 2A. The second adjusting structure 2B are provided on the end of the bar element 21 with a hollow part 211. The bar element 21 can be adjusted to have different orientations and positions according to the first adjusting structure 2A. In practice, several bar elements 21 are disposed at appropriate positions on the vertical bar 12 according to the need. Moreover, the bar element 21 can be hollow through both ends.

One end of the side bar 22 goes through the second adjusting structure 2B and further into the hollow part 211 or protrudes outward from the side of the bar element. That is, the side bar 22 can be adjusted to have several orientations and positions according to the second adjusting structure 2B. The other end of the side bar 22 has an instrument. In this embodiment, the other end of the side bar 22 is bent upward with a screw head 221. The instrument here is a practicing drum 23. The practicing drum 23 includes a plastic dish 231 and a foam structure 232 disposed on the plastic dish 231. The bottom of the plastic dish 231 is screw-fastened to the screw head 221.

In this embodiment, the first and second adjusting structures have the same structure. Each of them has a supporting base 24, an adjusting base 25, and a positioning structure 26. Each of the supporting bases 24 has a recess part 241 having a first through hole 242. A first tooth part 243 surrounds the recess part 241 of the supporting base 24. In this embodiment, each of the supporting bases 24 further has a concave part (not shown) on the outer side of the first through hole 242. The concave part has a pad 244.

Figure 5:
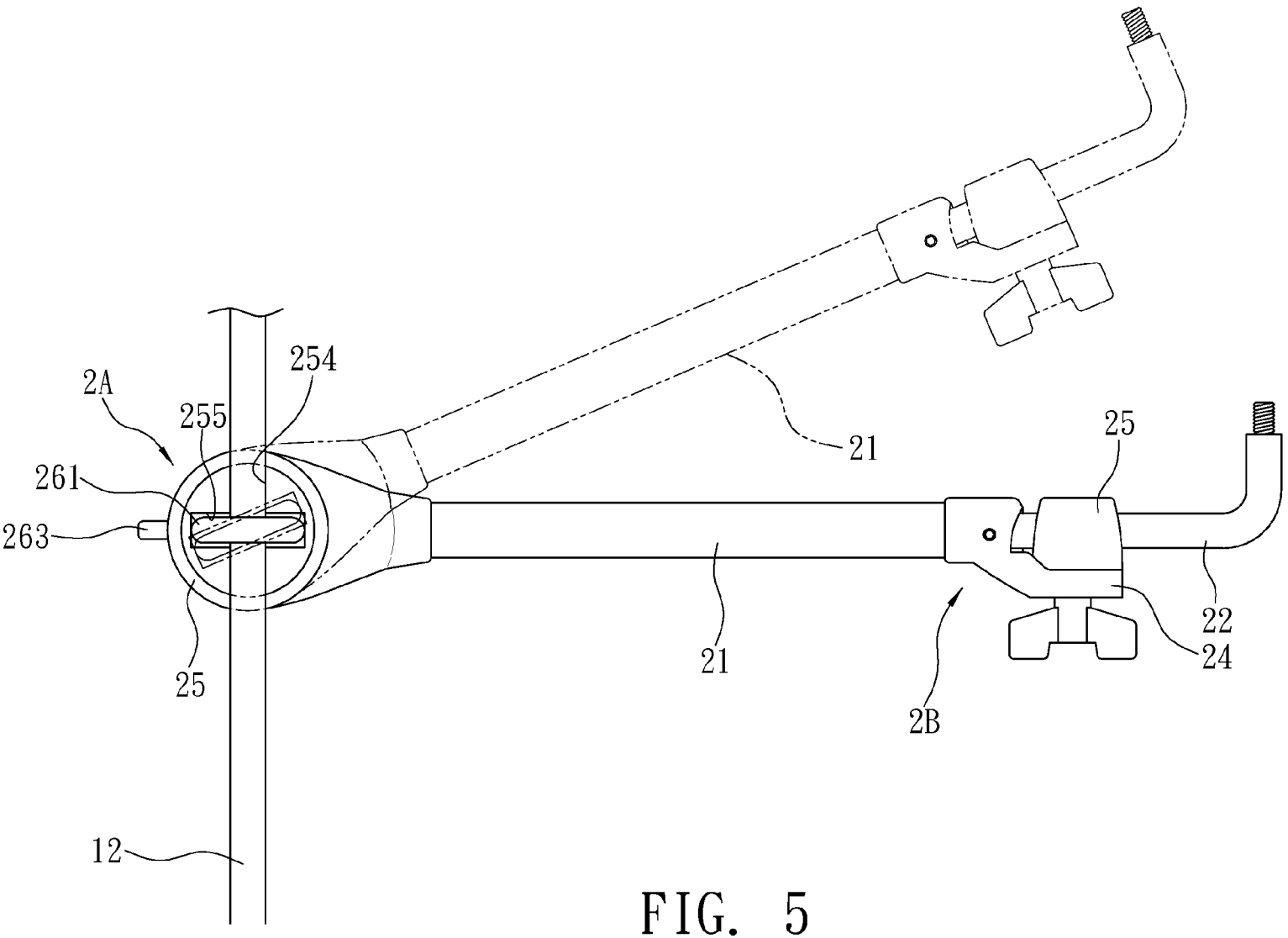
FIG. 5 is a side view of the disclosed bar element adjusting its vertical position.

Each of the adjusting bases 25 is disposed on the corresponding supporting base 24. One side of the adjusting base 25 has a protruding part 251 provided in the corresponding recess part 241. The protruding part 251 has a second through hole 252 corresponding to the first through hole 242. A second tooth part 253 surrounds the protruding part 251 and matches with the first tooth part 243. The recess part on the other side of each of the adjusting bases 25 has a channel 254. A position limiting recess 255 is provided in the direction perpendicular to the channel 254. The position limiting recess 255 is shown in FIGS. 1 and 5. In this embodiment, the first and second through holes 242, 252 of the first and second adjusting structures 2A, 2B on both ends of the bar element 21 are perpendicular to each other.

Moreover, each of the positioning structures 26 has a ring part 261 that is hollow and inside the position limiting recess 255. The ring part 261 is connected with a protruding bar 262 with a thread. The protruding bar 262 goes through the first and second through holes 242, 252. The outer end of the protruding bar 262 is connected with a rotating element 263 with an inner thread. The rotating element 263 urges against the pad 244 when it is fastened.

In other words, the rotating element 263 can be screw-fastened on the protruding bar 262 to approach or leave the ring part 261. This adjusts how the ring part 261 urges against the object going through it (e.g., the vertical bar 12 or side bar 22 in the embodiment). Moreover, the rotating element 263 of the first adjusting structure 2A is on the side surface. The rotating element 263 of the second adjusting structure 2B is in the lower part. This is convenient for manipulations.

In this embodiment, an engaging structure 261A is provided along the inner circumference of the ring part 261. An anti-skid structure 222 urging against the engaging structure is provided around the outer circumference of the side bar 22, thereby producing a better urging and positioning effect. Furthermore, the anti-skid structure (not shown) on the vertical bar 22 tightly urges against the ring part 261 of the first adjusting structure 2A to provide a better anti-skid effect.

Figure 3:
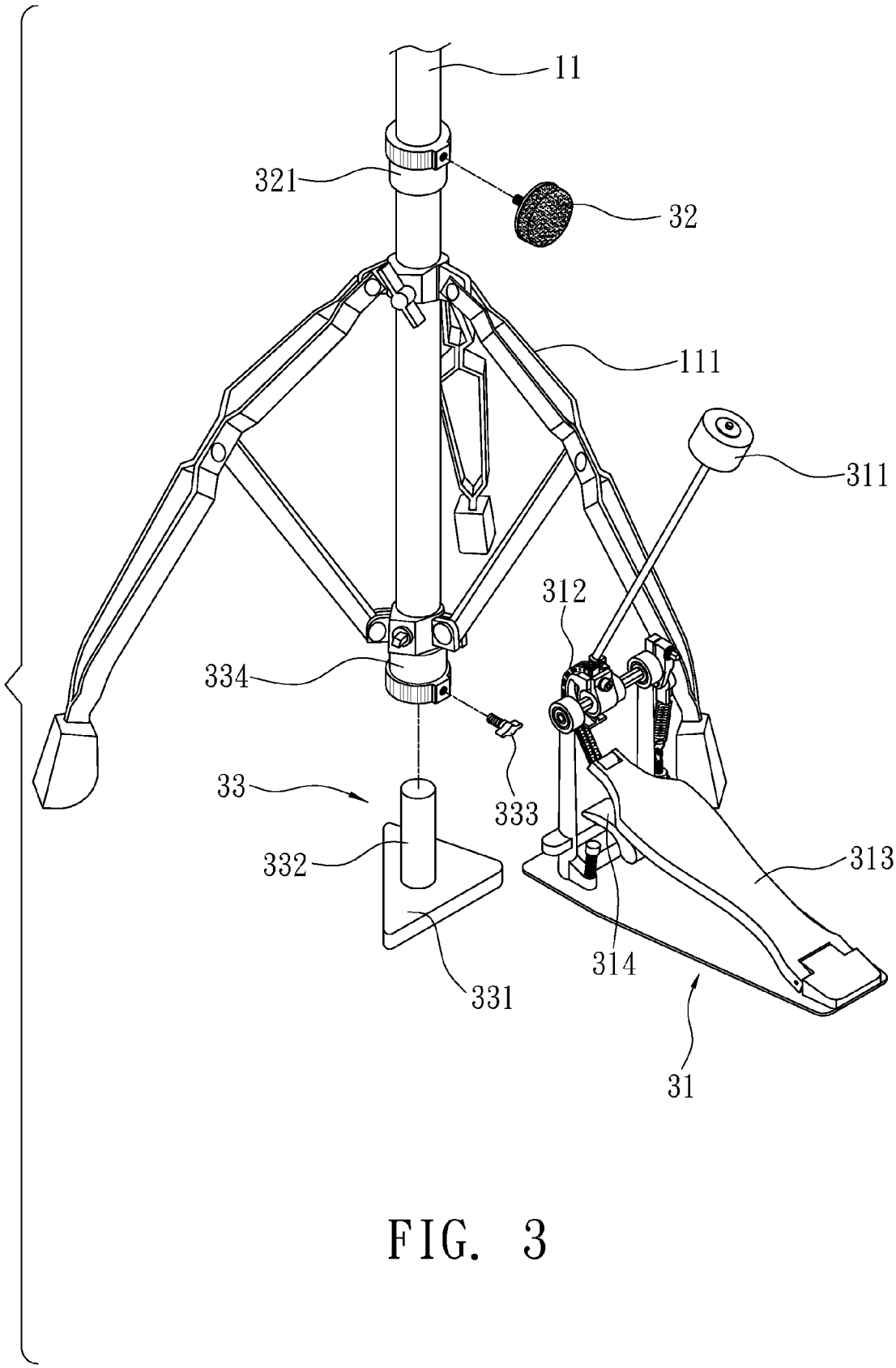
FIG. 3 is a schematic view of the disclosed pipe element in combination with an instrument pedal.
Figure 4:
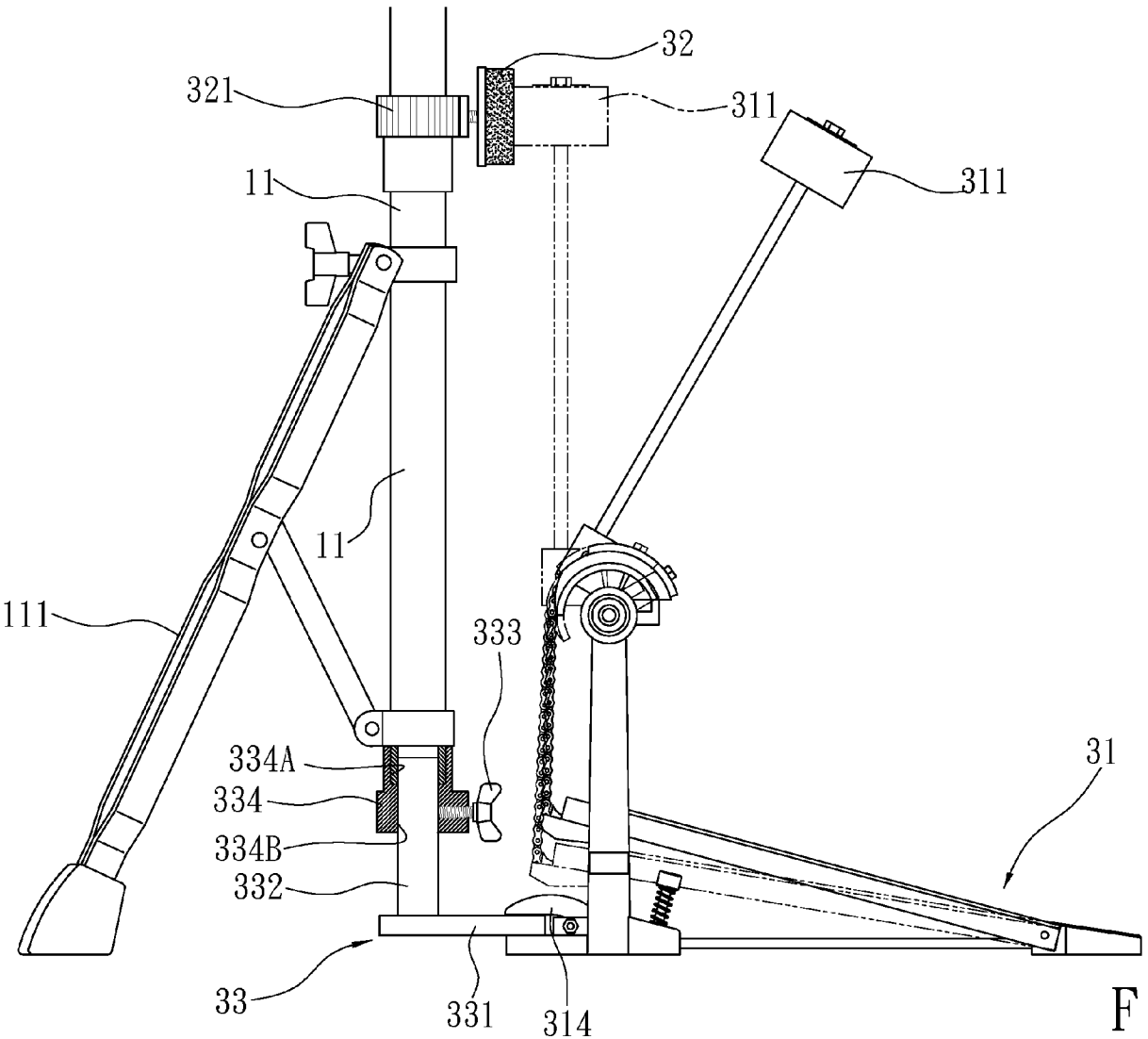
FIG. 4 is a side cross-sectional view of FIG. 4.

Please refer to FIGS. 3 and 4. An instrument pedal 31 is disposed next to the stand 111 of the pipe element 11. The instrument pedal 31 has a drumstick 311, which is connected with a driving chain 312 at the bottom. The chain connects to a pedal 313 (other elements belong to the prior art and are not explained herein). The pipe element 11 is provided with a foam pad 32 for the drumstick 311 to hit. The foam pad 32 is screw-fastened to a connecting element 321 on the pipe element 11. The connecting element 321 is above the stands 111 and can adjust vertically on the pipe element 11, so as to reach an optimal distance and hitting position for the drumstick 311. A connecting structure 33 is interposed between the instrument pedal 31 and the pipe element 11. The connecting structure 33 has a bottom board 331, whose one side is held and positioned by a holding element 314 on the instrument pedal 31. The bottom end of the pipe element 11 is mounted with a ring object 334. The other side of the bottom board 331 has a positioning bar 332, penetrating from the bottom end of the ring object 334 to the bottom end of the pipe element 11. A locking element 333 goes through the lower sidewall of the ring object 334 and urges against the sidewall of the positioning bar 332.

In this embodiment, the interior of the ring object 334 consists of a large-diameter space 334A and a small-diameter space 334B. The junction between the large- and small-diameter spaces 334A, 334B has a ladder shape. The bottom end of the pipe element 11 goes through the large-diameter space 334A. The positioning bar 332 goes through the small-diameter space 334B and into the pipe element 11 at the large-diameter space 334A. The locking element 333 goes through the ring object 334 to the small-diameter space 334B, urging and positioning the positioning bar 332. Therefore, the positioning bar 332 is firmly fixed so that the instrument pedal 31 and the pipe element 11 do not become loose due to vibrations.

In this embodiment, the fixing structure 13 for fixing the vertical bar 12 on the pipe element has the same structure as that of the first and second adjusting structures 2A, 2B. The vertical bar 12 is thus positioned.

Please refer to FIG. 5, a side view of the bar element 21 that adjusts its vertical position. The adjusting base 25 of the first adjusting structure 2A is rotated to find its engaging position. The user then fastens the rotating element 263 of the positioning structure, so that the ring part 261 is sturdily fixed on the vertical bar 12. The bar element 21 can thus adjust vertically at the fixed position (e.g., the height of the first adjusting structure 2A is invariant). Of course, one can directly adjust the height of the first adjusting structure 2A after loosening the rotating element 263 and ring part 261 thereof.

Figure 6:
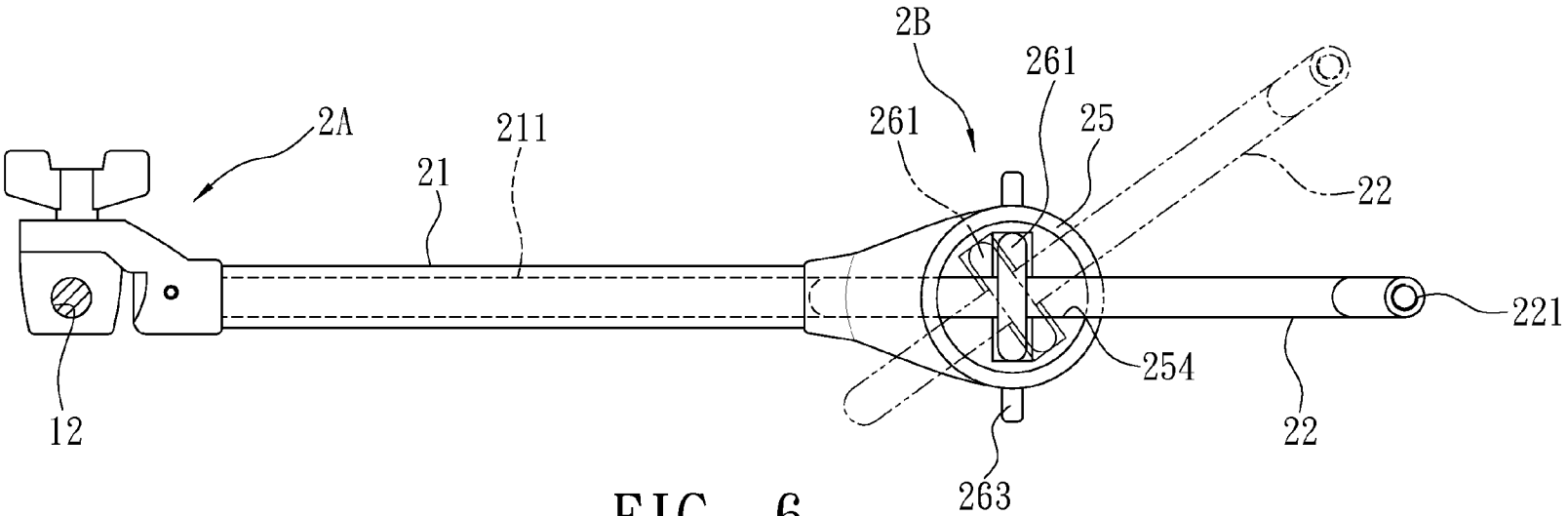
FIG. 6 is a top view of the disclosed side bar at different positions.
Figure 7:
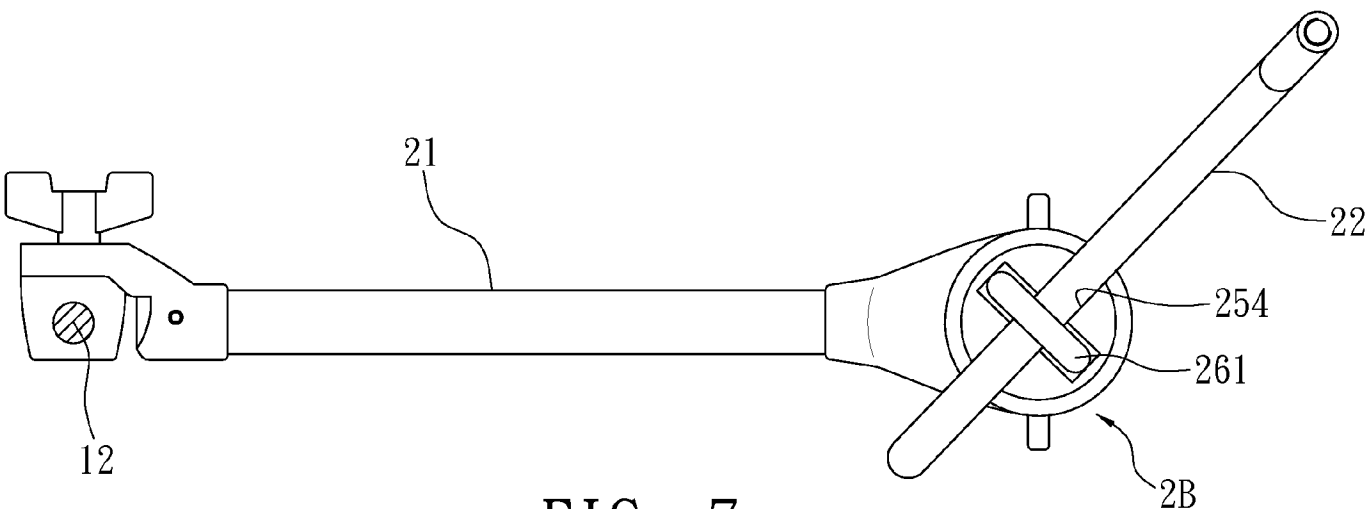
FIG. 7 is a top view of the disclosed side bar at another position.

Please refer to FIGS. 6 and 7 for the top views of the side bar 22 at different positions. One end of the side bar 22 goes through the channel 254 and the ring part 261 on the adjusting base of the second adjusting structure 2B. It can selectively go into the hollow part 211 of the bar element 21 or protrude from the outer side of the bar element 21. The ring part 261 of the positioning structure 26 on the second adjusting structure 2B urges and positions the side bar 22. Of course, this allows the adjustment for different positions and orientations of the side bar 22.

Figure 8:
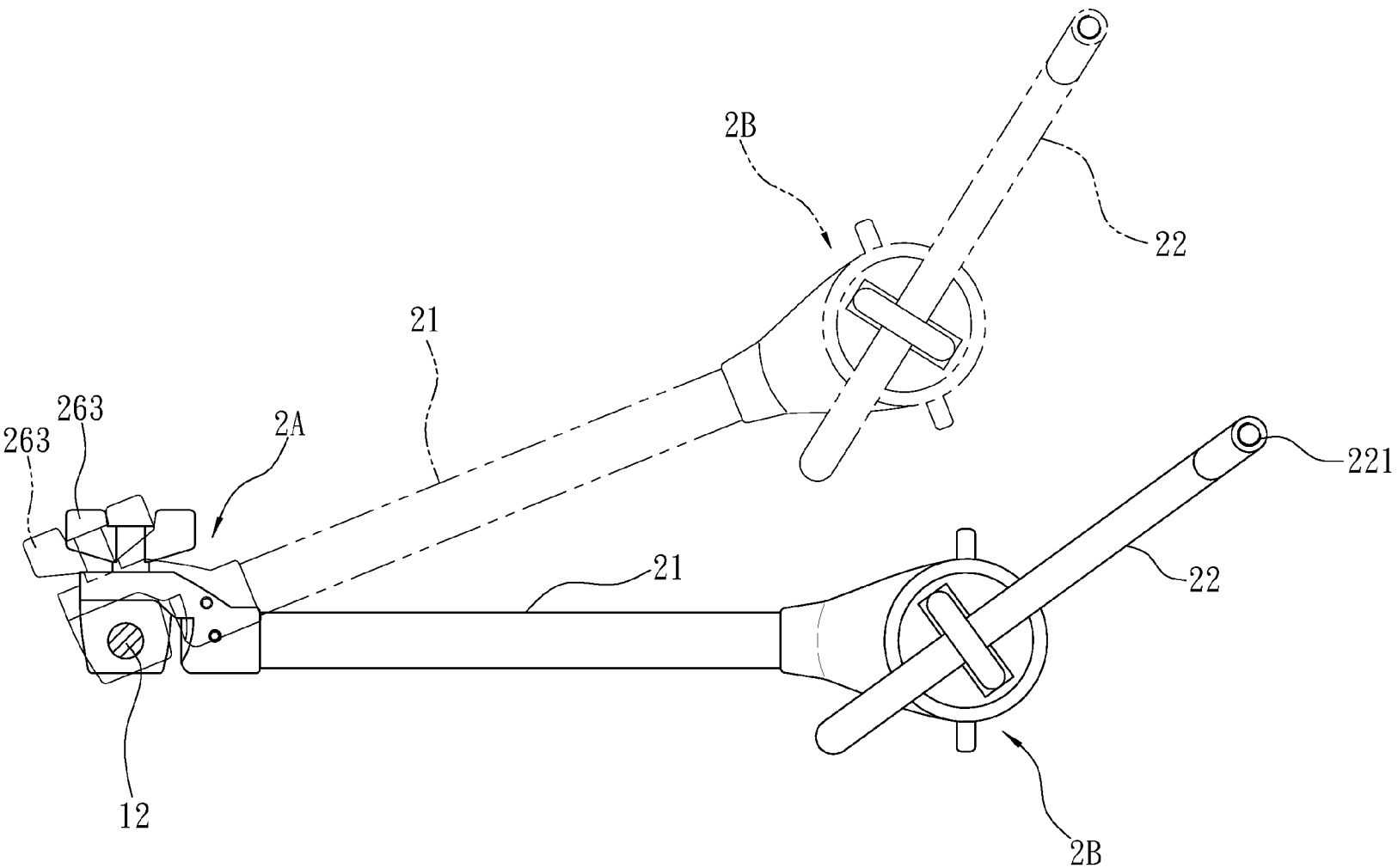
FIG. 8 is a top view of the disclosed bar element adjusting its horizontal position.
Figure 9:
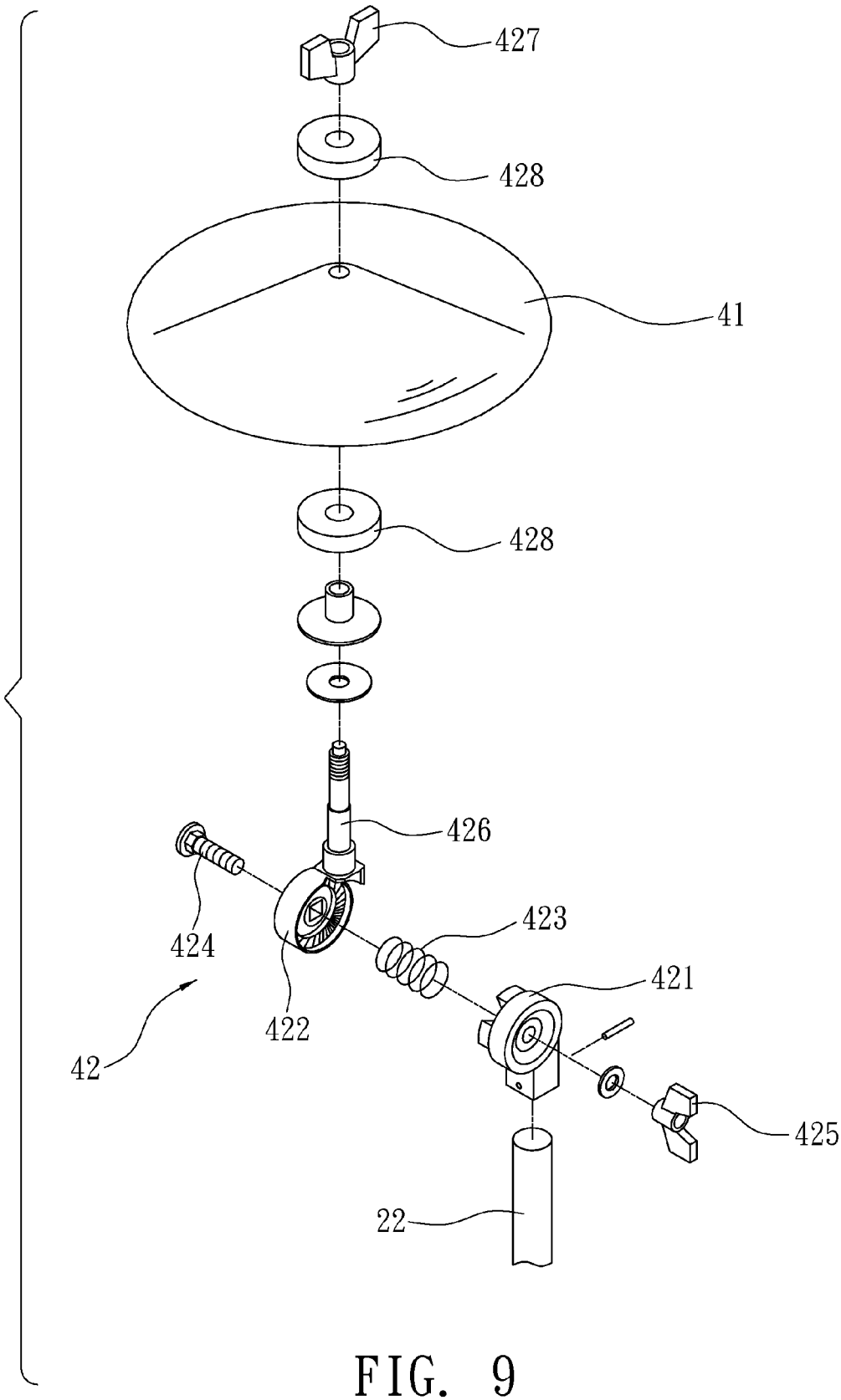
FIG. 9 is an exploded view of the connecting component when the instrument is a cymbal.
Figure 10:
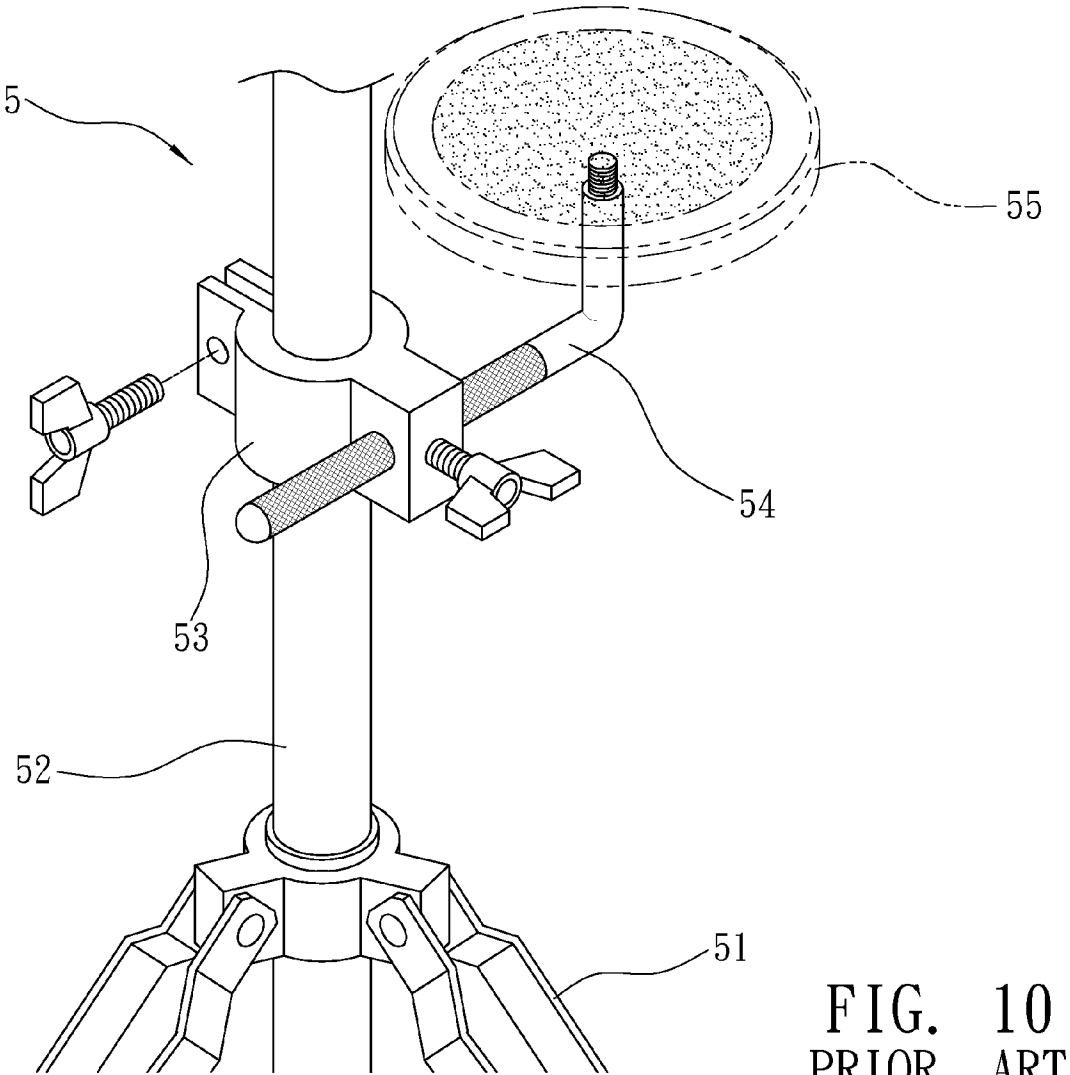
FIG. 10 PRIOR ART
FIG. 10 is a three-dimensional view of the conventional placement support of instrument.
Figure 11:
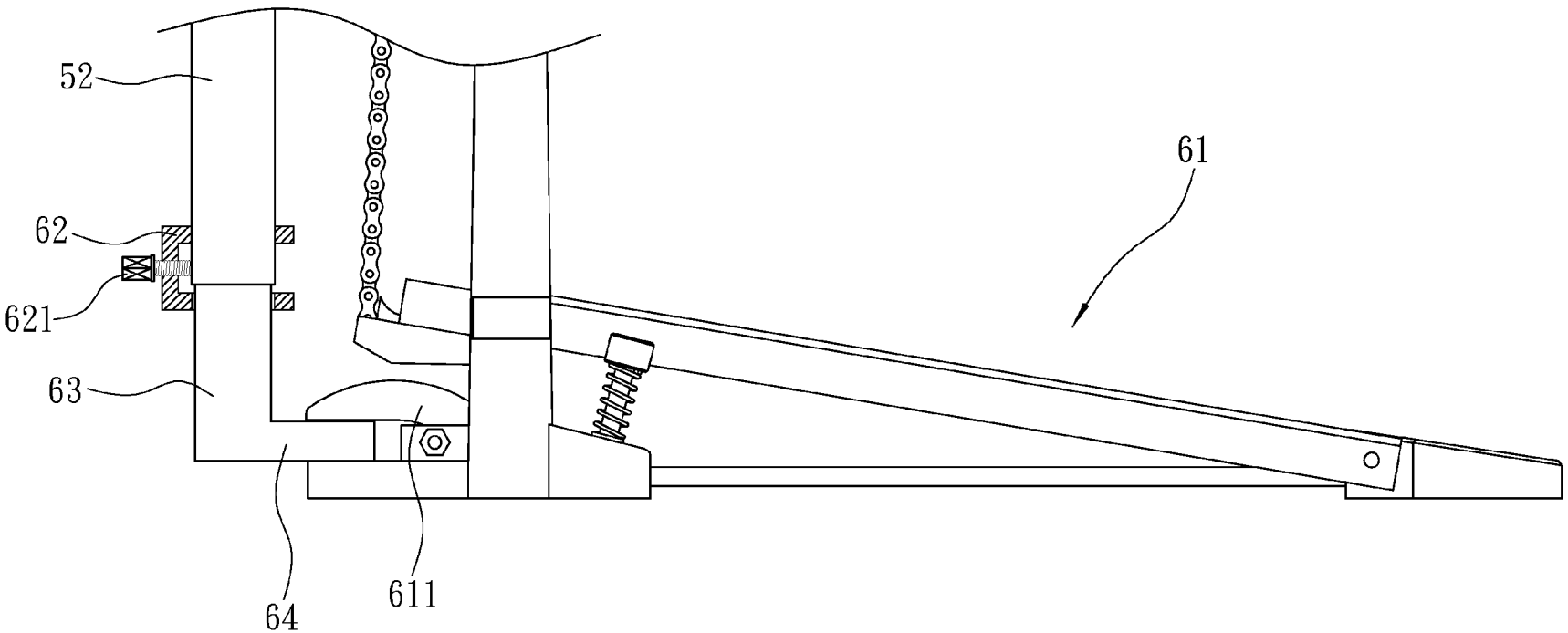
FIG. 11 PRIOR ART
FIG. 11 is a schematic view of the connection and positioning between the conventional instrument placement support and the instrument pedal.

Please refer to FIG. 8 for a top view of the bar element 21 adjusting its horizontal position. This is achieved by fastening and loosening the rotating element 263 of the positioning structure 26 on the first adjusting structure 2A.

Besides, when the side bar 22 is in the channel 254 and the ring part 261 of the second adjusting structure 2B, it can rotate in the ring part 261 to obtain different orientations, as shown in the drawing.

According to the above description, the invention has the first and second adjusting structures on an instrument support so that the bar element and the side bar can assume different orientations and positions. Consequently, the instrument disposed on the side bar can be adjusted to an appropriate hitting position for the user. The invention is thus convenient and easy in adjustment. Moreover, the connecting structure achieves the firm positioning effect between the instrument pedal and the pipe element. Therefore, there is no problem of getting loose or falling apart.

The invention of course has many other embodiments that only differ in detail. Please refer to FIG. 9 for a second embodiment. The instrument is a cymbal 41, which is connected with the side bar 22 using a connecting component 42. The connecting component 42 allows the cymbal 41 to vary its orientation relative to the side bar 22. When the cymbal 41 is disposed on the support, it is just like FIG. 1.

Moreover, the connecting component 42 includes a first base 421 and a second base 422, which are engaged with each other by tooth parts and interposed with a spring 423. A screw element 424 goes through the center of the first and second bases 421, 422. The other end of the screw element 424 is fastened with a rotating element 425. One can rotate the rotating element 425 to adjust the tightness between the first and second bases 421, 422. Besides, the first base 421 is connected with the side bar 22. The second base 422 is disposed with a vertical connecting bar 426. The connecting bar 426 goes through the cymbal 41 and connects with another rotating element 427. The top and bottom surfaces of the cymbal 41 are provided with stopping elements 428 for buffering as the cymbal 41 is fastened.

In addition to hold a practicing drum, the above embodiment shows that the invention can be used to hold a cymbal. Likewise, other similar instruments can be held by the invention as well.

Although the invention has been described with reference to specific embodiments, this description is not meant to be construed in a limiting sense. Various modifications of the disclosed embodiments, as well as alternative embodiments, will be apparent to people skilled in the art. Therefore, it is contemplated that the appended claims will cover all modifications that fall within the true scope of the invention.

What is claimed is:

1. A support for an electronic drum, comprising:

a pipe element with a plurality of stands, the pipe having an outer side with a fixing structure and a bottom end;

a vertical bar extending into the pipe element, wherein the fixing structure of the pipe element positions the vertical bar;

at least one bar element with two ends disposed on the vertical bar, the at least one bar element has a hollow part on at least one end, the at least one bar element having a first adjusting structure at a first end and a second adjusting structure at a second end, wherein the vertical bar extending into the first adjusting structure and the second adjusting structure having a hollow part for enabling the at least one bar element to change orientation and position;

a side bar with a first end and a second end, the first end of the side bar extending into the second adjusting structure and into the hollow part, the side bar being capable of changing orientation and position according to the second adjusting structure and the the second end of the side bar being disposed with an instrument; and an instrument pedal disposed adjacent the plurality of stands and has a drumstick;

wherein the pipe element is provided with a foam pad, a connecting structure is interposed between the instrument pedal and the pipe element, the connecting structure has a bottom board with a first side held and positioned by a holding element on the instrument pedal, the bottom end of the pipe element is mounted with a ring element, a second side of the bottom board being equipped with a positioning bar penetrating from the bottom of the ring element into the pipe element, and a locking element penetrating through a sidewall of the ring element and urging against a sidewall of the positioning bar.

2. The support for an electronic drum of claim 1, wherein the first adjusting structure and the second adjusting structure have the same structure of a supporting base, an adjusting base, and a positioning structure, each supporting base having a recess part with a first through hole and the recess part being surrounded by a first tooth part;

each adjusting base is disposed on a supporting base and has a protruding part on the recess part, the protruding part having a second through hole opposite to the first through hole, the protruding part being surrounded by a second tooth part corresponding to the first tooth part, the adjusting base having a channel and a position limiting recess being disposed perpendicular to the channel;

each positioning structure has a ring part that is hollow and disposed inside the position limiting recess, the ring part being connected with a protruding bar with an outer thread and an outer end, the protruding bar penetrating through the first and second through holes, and the outer end of the protruding bar being connected with a rotating element with an inner thread;

the first end of the side bar extending through the channel of the adjusting base of the second adjusting structure and the ring part, and the first end of the side bar adjustably extending into the hollow part; and the first and second through holes of the first and second adjusting structures being perpendicular to each other.

3. The support for an electronic drum of claim 2, wherein the second end of the side bar for holding the instrument is bent and has a screw head, the instrument is a drum including a plastic dish and a foam structure disposed on the plastic dish, and the bottom of the plastic dish is screw-fastened on the screw head.

4. The support for an electronic drum of claim 2, wherein the ring part having an inner ring with an engaging structure and the side bar having an outer ring with an anti-skid structure urging against the engaging structure.

5. The support for an electronic drum of claim 2, wherein each supporting base has a recess part on the outer side of the first through hole, the recess part has a pad, and the rotating element urges against the pad.

6. The support for an electronic drum of claim 2, wherein the fixing structure has the same structure as that of the first and second adjusting structures for positioning the vertical bar.

7. The support for an electronic drum of claim 1, wherein the instrument is a cymbal connected to the side bar by a connecting component and the connecting component allows the cymbal to change its orientation relative to the side bar.

8. The support for an electronic drum of claim 1, wherein the inside of the ring element has a large-diameter space and a small-diameter space, the bottom end of the pipe element extending into the large-diameter space, the positioning bar extending through the small-diameter space and into the large-diameter space of the pipe element, and the locking element penetrates through the ring element into the small-diameter space to urges against and position the positioning bar.

9. The support for an electronic drum of claim 1, wherein the foam pad is attached to a connecting element mounted on the pipe element and the connecting element is disposed above the stands to vertically adjust its position on the pipe element.

* * * * *